US007862425B2

(12) United States Patent
Cavagna

(10) Patent No.: US 7,862,425 B2
(45) Date of Patent: Jan. 4, 2011

(54) METHOD AND SYSTEM FOR ALLOCATING LOYALTY REWARD POINTS TO GAMING PLAYERS

(76) Inventor: Phillip Cavagna, 81 Roseberry Street, Hawthorn East, Victoria (AU) 3123

( * ) Notice: Subject to any disclaimer, the term of this patent is extended or adjusted under 35 U.S.C. 154(b) by 1204 days.

(21) Appl. No.: 11/276,986

(22) Filed: Mar. 20, 2006

(65) Prior Publication Data

US 2006/0217185 A1 Sep. 28, 2006

(30) Foreign Application Priority Data

Mar. 23, 2005 (AU) ..... 2005901435

(51) Int. Cl.
*A63F 9/24* (2006.01)
*G06F 19/00* (2006.01)
*G07F 1/06* (2006.01)

(52) U.S. Cl. ..... 463/25; 463/42; 463/11; 463/17; 463/29; 194/214; 273/146; 273/292

(58) Field of Classification Search ..... 463/25, 463/29, 42, 11, 17; 705/14; 194/214; 273/146, 273/292

See application file for complete search history.

(56) References Cited

U.S. PATENT DOCUMENTS 5,735,742 A 4/1998 French
6,267,671 B1 * 7/2001 Hogan ..... 463/25
2002/0123376 A1 * 9/2002 Walker et al. ..... 463/11
2003/0003997 A1 * 1/2003 Vuong et al. ..... 463/42
2003/0027632 A1 * 2/2003 Sines et al. ..... 463/29
2005/0026680 A1 * 2/2005 Gururajan ..... 463/25
2005/0054408 A1 * 3/2005 Steil et al. ..... 463/11
2006/0068878 A1 * 3/2006 Krenn et al. ..... 463/17

* cited by examiner

*Primary Examiner*—Peter Dungba Vo
*Assistant Examiner*—Frank M Leiva
(74) *Attorney, Agent, or Firm*—David A. Guerra

(57) ABSTRACT

A system for allocating loyalty reward points to a player at a gaming area, where the player has a loyalty reward card. The player further being associated with identifiable casino chips each having a radio frequency identification tag. The system has a recording device located in the vicinity of the gaming area for reading and recording the player details on the loyalty reward card, and RFID readers for detecting player casino chips located in play in the gaming area. The RFID reader is operatively connected to the recording device such that at the completion of bet placement the value of player casino chips in play in the gaming area detected by the RFID reader is communicated to the recording device thus enabling the value of bets placed by individual players to be calculated and thereby determining the allocation of loyalty reward points to individual players for the particular bet placement.

13 Claims, 1 Drawing Sheet

METHOD AND SYSTEM FOR ALLOCATING LOYALTY REWARD POINTS TO GAMING PLAYERS

CROSS-REFERENCE TO RELATED APPLICATIONS

This application claims foreign priority benefits under 35 U.S.C. 119 to co-pending Australian patent application number 2005901435, filed Mar. 23, 2005. This related patent application is herein incorporated by reference in its entirety.

FIELD OF THE INVENTION

The present invention relates to a system and method for allocating loyalty reward points to gaming players. The present invention is particularly suited to allocating loyalty reward points to players of table based games in casinos.

BACKGROUND OF THE INVENTION

Casinos typically offer consumers the opportunity to join loyalty programs and earn points towards rewards and special offers based upon the value of their wagers or bets whist in the casino. Currently, there are systems available that enable electronic data capture of a member's activity in a casino through the use of a loyalty card. Typically there are three main areas in a casino where consumers can accrue points based upon the amount they spend. The three main areas being the gaming machine area, the table game area and the non-gaming areas which include restaurants, bars, gift shops, etc.

In the gaming machine areas, casinos typically utilize software packages linked to card readers located on the gaming machines to monitor and record a players' activity on the gaming machine. Typically, players swipe their loyalty reward card through a card reader or insert their card into a card reader on the gaming machine prior to the commencement of play.

Similarly, in non-gaming areas of the casino, card readers are utilized at the point of purchase to record the amount spent by the member. The information recorded enables the casino to deliver to the member additional value, service and rewards based upon the amount spent and gambled by the member within the casino thus rewarding them for their loyalty to the casino.

Whilst the process of recording the amount spent and gambled by a member is relatively straightforward in gaming machine and non-gaming areas, the process is significantly more difficult and labour intensive at table game areas. When a member presents their loyalty reward card at a gaming table, the croupier will typically record the time that the member joins the table. Upon the member finishing at the table, the croupier will calculate the total time spent by the member at the table. In addition, the croupier will calculate the average number of hands played and the average number of bets placed by the member during the time period to estimate the total value of bets placed by the member during the period of play. Based upon this calculation, the member will be awarded a certain number of reward points.

A problem with allocating points to table game players in this manner is that the casino is at risk of providing more points than has actually been earned. In addition, the process is time consuming and overly burdensome on the croupier.

Accordingly, an object of the present invention is to provide a system and method for allocating loyalty reward points that overcomes or ameliorates at least one of the problems of known systems and methods.

Any discussion of documents, devices, acts or knowledge in this specification is included to explain the context of the invention. It should not be taken as an admission that any of the material formed part of the prior art base or the common general knowledge in the relevant art or other countries on or before the priority date of the claims herein.

SUMMARY OF THE INVENTION

In accordance with a first aspect of the invention there is provided a system for allocating loyalty reward points to a player at a gaming area, the player having a loyalty reward card with player details recorded thereon, the player further being associated with uniquely identifiable casino chips each having an electronic identification means, the system including:

)recording means located in the vicinity of the gaming area for reading and recording the player details on the loyalty reward card;

a first casino chip detection means for detecting player casino chips located in play in the gaming area;

wherein the first casino chip detection means is operatively connected to the recording means such that at the completion of bet placement the value of player casino chips in play in the gaming area detected by the first casino chip detection means is communicated to the recording means thus enabling the value of bets placed by individual players to be calculated and thereby determining the allocation of loyalty reward points to individual players for the particular bet placement.

In a preferred embodiment, the value of bets placed by players is transmitted to a database that cumulatively stores information pertaining to the loyalty reward points of members.

Preferably the first casino chip detection means detects and communicates the value of player casino chips in play at the completion of each round of bet placement over the duration of the game to the recording means. Subsequently, the recording means can record the value of player casino chips in play at the completion of each round of bet placement over the duration of the game and also record the accumulated value of player casino chips in play at the completion of the game. Alternatively, the recording means can send the recorded value of player casino chips in play at the completion of each round of bet placement to a database that calculates and records the accumulated value of player casino chips in play over the duration of the game. The allocation of loyalty reward points to individual players can then be based upon the accumulated value.

In a preferred embodiment of the invention, a second casino chip detection means operatively connected to the recording means is also provided. The second casino chip detection means is preferably associated with a single player and detects player casino chips out of play in the gaming area and determines those casino chips out of play that are not associated with the player. The recording means preferably associates all casino chips detected h the vicinity of the second detection means with the individual player associated with the second detection means.

In a particularly preferred embodiment, players are able to purchase additional casino chips at the gaming table and to place the additionally purchased chips within the vicinity of the second casino chip detection means thus associating any additional casino chip purchases at the gaming area with the player. Similarly, casino chips detected by the second casino chip detection means includes casino chips won from other players at the gaming area during play.

In a particularly preferred embodiment a plurality of second casino chip detection means are provided at various locations of the gaming area. Further, each second casino chip detection means is preferably operatively connected to the recording means. In addition, each player at the gaming area is allocated an individual second casino chip detection means such that the detection means allocated to each player can be associated with their details read and recorded by the recording means from their loyalty reward card.

In accordance with a second aspect of the invention there is provided a method of allocating loyalty reward points to a player at a gaming area, the player having a loyalty reward card with player details recorded thereon, the player further being associated with uniquely identifiable casino chips each having an electronic identification means, the method including the steps of:

reading and recording the player details recorded on their loyalty reward card;

detecting and recording the value of player casino chips located in play in the gaming area at the completion of bet placement with a first casino chip detection means and associated recording means;

determining the allocation of loyalty reward points to the player in accordance with the recorded value of player casino chips in play; and allocating the loyalty reward points to the player.

In a preferred embodiment the method further includes the step of detecting player casino chips out of play in the gaming area with a second casino detection means that is associated with an individual player In a particularly preferred embodiment, the step of detecting player casino chips out of play includes detecting casino chips won from other players at the gaming area or additional casino chips purchased at the gaming area by the player. The method preferably includes the step of associating casino chips detected in the vicinity of the second chip detection means with the individual player with whom the second chip detection means is associated.

In an embodiment of the invention, the method of allocating loyalty reward points may include the additional step of allocating each player at the gaming area with an individual second casino chip detection means and additionally reading and recording each player's details from their loyalty card and associating each player's second chip detection means with their identification details.

The gaming area is preferably a gaming table and the electronic identification means may be a radio frequency identification tag.

BRIEF DESCRIPTION OF THE DRAWING

A preferred embodiment of the invention will now be described which should not be considered as limiting any of the statements in the previous section. The preferred embodiment will be described with reference to FIG. 1 which illustrates a gaming table incorporating a system for allocating loyalty reward points according to an embodiment of the invention.

DETAILED DESCRIPTION OF A PREFERRED EMBODIMENT

Figure 1:
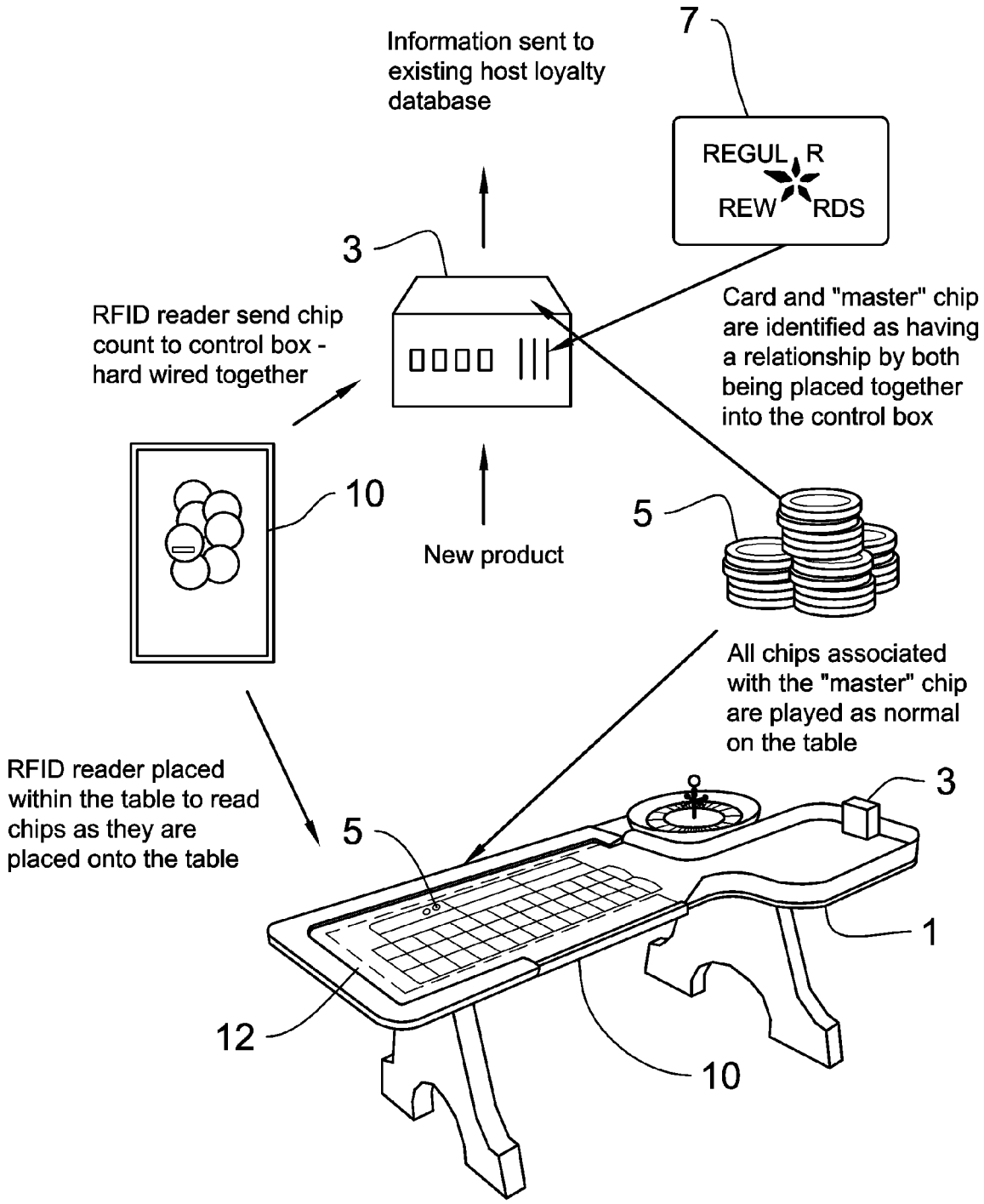

With reference to the accompanying drawing there is shown a gaming area which is preferably in the form of a gaming table 1. Associated with the gaming table 1 is a recording means 3. The recording means 3 may be mounted on the gaming table 1 near the croupier (not shown) or alternatively remotely located. The recording means 3 is operatively connected to a first casino chip detection means 10 which is mounted underneath the gaming table 1 adjacent to the in-play portion of the gaming table 1. Alternatively, the first casino chip detection means 10 may be located immediately under the surface of the in-play portion of gaming table 1. The first casino chip detector preferably includes a radio frequency identification (RFID) reader which is able to detect player casino chips in play. In this regard, each casino chip 5 has an electronic identification means located therein which is preferably a radio frequency identification (RFID) tag to enable detection by a radio frequency identification (RFD) reader.

Further, each casino chip 5 is uniquely identifiable and can be associated with an individual player at the gaming table 1. Upon arrival of a player at the gaming table 1, the loyalty reward card 7 of the player having the player details recorded thereon is read and recorded by the recording means 3.

Located at player positions around the gaming table 1 are a plurality of second casino chip detection means 12 which are each operatively connected to the recording means 3. The second casino chip detection means 12 also include (RFID) readers. Each player at the gaming table 1 upon arrival provide their loyalty reward card 7 to the croupier who places the player's card in a card reader located within the recording means 3. A specific player location is allocated to the player and a second chip detection means is associated with the details read and recorded by the recording means 3 from the player's loyalty reward card 7.

In an alternative embodiment, each second chip detection means allocated to players is provided with a card reader such that each player can swipe or insert their loyalty card to associate the details recorded on their loyalty reward card 7 with their second chip detection means allocated to them.

As players place their casino chips 5 in play on the gaming table 1 the first casino chip detection means 10 located underneath the in-play portion of the table is able to detect all chips located in play in the gaming area. In this regard, the RFID readers of the first casino chip detection means 10 detects the player casino chips in-play which are then recorded by the recording means 3. Each time a hand is dealt or the wheel is spun the recording means 3 will detect and identify the chips located on the table and note which player they are associated with. This information is then used to determine the allocation of loyalty reward points to the player based upon the total value of the bet placed by each individual player.

When a player wins other players' casino chips or chips from the table the player is able to associate the casino chips 5 with themselves by placing the chips over the second casino chip detection means 12 that has been allocated to them. The second casino chip detection means 12 can then detect the casino chips 5 won from the table and/or other players at the gaming table and thereby associate the casino chips 5 with the correct player. This information is then communicated back to the recording means 3 and recorded. The recording means 3 thereby tracks the casino chips in each player's possession as they are won and lost during bet placements throughout the duration of the game.

As soon as the loyalty reward card 7 of a player is read by the recording means 3 or card reader allocated to each second casino chip detection means 12, a message can be provided to the croupier at the gaming table with the member information. In this regard, the member information may provide a rating of importance of the player to the casino or other information such as an indication that the details of the player require updating.

In an alternative embodiment, upon arrival at the gaming table 1, the croupier will choose a range or colour of chips that the player purchases. These chips will have a master chip that electronically carries on it the code that other associated chips are encoded with. The croupier will then place this master chip information into the recording means 3 and the player will place their card into a receiving slot also located within the recording means 3. By placing the master chip and card into the recording means 3, the recording means 3 associates the player with the particular range or colour of chips selected by the croupier.

At the completion of the game, the recording means 3 having counted and recorded the number and value of player chips in play on the gaming table 1 throughout the game will determine the allocation of loyalty reward points to the player and allocate the loyalty reward points to the player.

The present invention advantageously relieves the croupier from the laborious and time-consuming task of manually calculating the number of points which should be allocated to a player based upon the average number of hands played and the average bet of the member over the duration of the game and provides a much greater accuracy with respect to the allocation of reward points to players.

As the present invention may be embodied in several forms without departing from the essential characteristics of the invention, it should be understood that the above-described embodiment should not be considered to limit the present invention but rather should be construed broadly. Various modifications and equivalents are intended to be included within the spirit and scope of the invention.

The invention claimed is:

1. A loyalty reward points allocation system for allocating loyalty reward points to a player at a gaming area having a loyalty reward card with player details recorded thereon, said system comprising:

at least one uniquely identifiable casino chip having an electronic identification means, said identifiable casino chip being associated with said player;

a recording means located in the vicinity of said gaming area for reading and recording the player details on the loyalty reward card;

a first casino chip detection means for detecting said player associated casino chip located in play in said gaming area, said first casino chip detection means being operatively connected to said recording means; and wherein said first casino chip detection means is operatively connected to said recording means such that at the completion of bet placement the value of said player casino chip in play in said gaming area detected by said first casino chip detection means is communicated to said recording means thus enabling the value of bets placed by individual players to be calculated and thereby determining the allocation of loyalty reward points to individual players for the particular bet placement;

wherein said plurality of identifiable casino chips are divided into sets of coloured or marked chip sets, wherein each of said coloured or marked chip sets have a master chip that electronically carries on it the code that other associated coloured or marked chips are encoded with.

2. The loyalty reward points allocation system according to claim 1 further comprising a second casino chip detection means associated with a single player and operatively connected to said recording means for detecting said player casino chip out of play in said gaming area and associating said detected casino chips with the player.

3. The loyalty reward points allocation system according to claim 2, wherein said player casino chips detected by said second casino chip detection means includes casino chips won from other players at said gaming area.

4. The loyalty reward points allocation system according to claim 3, wherein said detected casino chips includes additional casino chips purchased at said gaming area.

5. The loyalty reward points allocation system according to claim 4, wherein said second casino chip detection means includes a plurality of second casino chip detection means which are each operatively connected to said recording means, and wherein each player at said gaming area is allocated an individual second casino chip detection means.

6. The loyalty reward points allocation system according to claim 5, wherein said second chip detection means allocated to each player is associated with their details read and recorded by said recording means from their said loyalty reward card.

7. The loyalty reward points allocation system according to claim 6, wherein said first casino chip detection means detects and communicates the value of said player casino chip in play at the completion of each round of bet placement over the duration of the game to said recording means.

8. The loyalty reward points allocation system according to claim 7, wherein said recording means records the value of said player casino chip in play at the completion of each round of bet placement over the duration of the game, the total value of player casino chips in play during the game at the completion of each round of bet placement, and the accumulated value of player casino chips in play at the completion of the game.

9. The loyalty reward points allocation system according to claim 8, wherein the allocation of loyalty reward points to individual players is based upon the accumulated value.

10. The loyalty reward points allocation system according to claim 6, wherein each player's said second casino chip detection means detects said casino chips adjacent to each player's said second casino chip detection means and communicates the casino chips detected to said recording means.

11. The loyalty reward points allocation system according to claim 10, wherein said recording means associates with each individual player casino chips detected by said players second casino chip detection means which have been won from other players.

12. The loyalty reward points allocation system according to claim 1, wherein said gaming area is a gaming table, said electronic identification means is radio frequency identification tag, and said first casino chip detection means is a radio frequency identification (RFID) reader.

13. A loyalty reward points allocation system comprising:

a gaming table having an in-play portion and individual player positions;

a loyalty reward card having a player's detail recorded thereon;

a plurality of uniquely identifiable casino chips having an electronic identification means, said identifiable casino chip being associated with a player, said identifiable casino chips having a frequency identification tag therein;

a recording means located in the vicinity of said gaming area for reading, recording, and transmitting the player details recorded on said loyalty reward card;

a first casino chip detection means for detecting said player associated casino chip located on said in-play portion of said gaming table, said first casino chip detection means being operatively connected to said recording means, said first casino chip detection means being mountable underneath said gaming table surface adjacent to said in-play portion of said gaming table, said first casino chip detection means being a radio frequency identification (RFID) reader; and a plurality of second casino chip detection means which are each operatively connected to said recording means, said second casino chip detection means being mountable underneath said gaming table surface adjacent to said individual player positions of said gaming table, said second casino chip detection means being a radio frequency identification (RFID) reader;

wherein said plurality of identifiable casino chips are divided into sets of coloured or marked chip sets, wherein each of said coloured or marked chip sets have a master chip that electronically carries on it the code that other associated coloured or marked chips are encoded with.

* * * * *